US005666835A

United States Patent [19]

Keller

[11] Patent Number: 5,666,835

[45] Date of Patent: Sep. 16, 1997

[54] KEY AND INSTALLATION DOUBLE CYLINDER FOR A SECURITY LOCK

[76] Inventor: Ernst Keller, Untere Schwandenstrasse 22, CH-8805 Richterswil, Switzerland

[21] Appl. No.: 388,979

[22] Filed: Feb. 15, 1995

[30] Foreign Application Priority Data

Mar. 4, 1994 [CH] Switzerland ..... 654/94

[51] Int. Cl.[6] ..... E05B 19/02

[52] U.S. Cl. ..... 70/397; 70/DIG. 60; 70/396

[58] Field of Search ..... 70/397, 395, 396, 70/399–401, 358, DIG. 60

[56] References Cited

U.S. PATENT DOCUMENTS

| | | | |
|---|---|---|---|
| 149,191 | 3/1874 | Brady | 70/396 |
| 160,660 | 3/1875 | Erbe | 70/396 |
| 1,438,525 | 12/1922 | Godlewski | 70/399 |
| 3,533,254 | 10/1970 | Albert | 70/399 |
| 3,974,671 | 8/1976 | Rossetti | 70/DIG. 60 X |
| 4,031,729 | 6/1977 | Gretler | 70/DIG. 60 X |
| 4,068,510 | 1/1978 | Neary | 70/DIG. 60 X |
| 4,120,184 | 10/1978 | Gerlach | 70/400 X |
| 4,195,504 | 4/1980 | Foshee | 70/DIG. 60 X |
| 4,292,824 | 10/1981 | Keller | 70/DIG. 60 X |
| 5,479,801 | 1/1996 | Keller | 70/DIG. 60 X |

FOREIGN PATENT DOCUMENTS

| | | | |
|---|---|---|---|
| 487 691 | 11/1929 | Germany . | |
| 31 25 796 | 6/1982 | Germany . | |
| 3828354 | 2/1990 | Germany | 70/DIG. 60 |
| 42 01 170 | 5/1992 | Germany . | |
| 7800771 | 7/1979 | Netherlands | 70/DIG. 60 |
| 397463 | 2/1966 | Switzerland | 70/DIG. 60 |

*Primary Examiner*—Rodney M. Lindsey
*Assistant Examiner*—Monica E. Millner
*Attorney, Agent, or Firm*—McAulay Fisher Nissen Goldberg & Kiel, LLP

[57] ABSTRACT

A key and an installation double cylinder for a security lock is disclosed with two cylinder halves, a cylinder core and tumblers which are constructed as core pins and housing pins and can be brought into line by means of the key, which can be inserted into the keyway to release the cylinder core for rotation. The key has, at its bit, a lengthening element by which the tumblers in an oppositely located cylinder half can be brought into line for free turning. The cylinder half on the outside of the door can have a solid rotor of hardened steel which protects the cylinder half on the inside.

12 Claims, 4 Drawing Sheets

KEY AND INSTALLATION DOUBLE CYLINDER FOR A SECURITY LOCK

BACKGROUND OF THE INVENTION a) Field of the Invention

The invention is directed to a key and an installation double cylinder for a security lock with two cylinder halves which are connected with one another, a cylinder core and tumblers which are constructed as core pins and housing pins and can be brought into line by means of the key which can be inserted into the keyway to release the cylinder core for rotation.

b) Description of the Related Art

A key and installation double cylinder of this kind is known from CH-A-626 679 by the present applicant. The two cylinder halves are connected and reinforced by a crosspiece of chromium-nickel steel. The cylinder housing of the two cylinder halves is formed by successive disks which are connected with one another in a stationary manner. This installation double cylinder already offers high security against break-in.

OBJECT AND SUMMARY OF THE INVENTION

The primary object of the present invention is to increase security against break-in.

This object is met in a key and installation double cylinder of the type mentioned above in that the key has, at its bit, a lengthening element by which the tumblers in an oppositely located cylinder half can be brought into line for free turning. In the installation double cylinder according to the invention, locking operation is also ensured when one cylinder half has no tumblers. In this cylinder half without tumblers, the rotor or a rotor half can be produced, e.g., from hardened steel. When installing the double cylinder, this cylinder half is generally arranged on the outside. The cylinder half with the tumblers is accordingly located on the inside of the door. The hardened-steel rotor arranged on the outside of the door protects the tumblers arranged on the inside and would have to be removed in order to break in, e.g., it would have to be cut out along its entire length which would be extremely involved. Since the key extends substantially along the entire length of the double cylinder, there is no need for a coupling so that manufacture is simplified. Since the outer sleeve can be produced without tumblers and since no coupling is required, as was just mentioned, the cylinder can be adapted exactly to any door thickness on the keying side. Accordingly, the cylinder can be prevented from projecting out on the outside and there is no need to attach an escutcheon.

According to a further development of the invention, the rotor is continuous and is provided with a thickened center part. The thickened center part effectively prevents the rotor from being broken off and pulled out.

According to a further development of the invention, the rotor has an insert which is drilled with a determined drilling pattern. The number of locking permutations can be doubled in a simple manner by rotating the insert.

When the lengthening element at the key is arranged so as to be movable and foldable according to a further development of the invention, the key can be given a conventional key length and will not be conspicuous in a bunch of keys. The key preferably comprises a standard element and the lengthening element. The length of the key can be adapted to cylinders of any length by the appropriate length of the lengthening element.

It is essential that the key be designed in such a way that it locks only from the outside or from both the outside and inside. Accordingly, locking authority in a security area can be structured in a more deliberate fashion than was previously possible. In addition to the key according to the invention, the installation in question can also have conventional keys for locking from the inside.

Further advantageous features are contained in the dependent claims, the following description and the drawing.

An embodiment example of the invention is explained more fully in the following with reference to the drawings.

DESCRIPTION OF THE PREFERRED EMBODIMENTS

Figure 1:
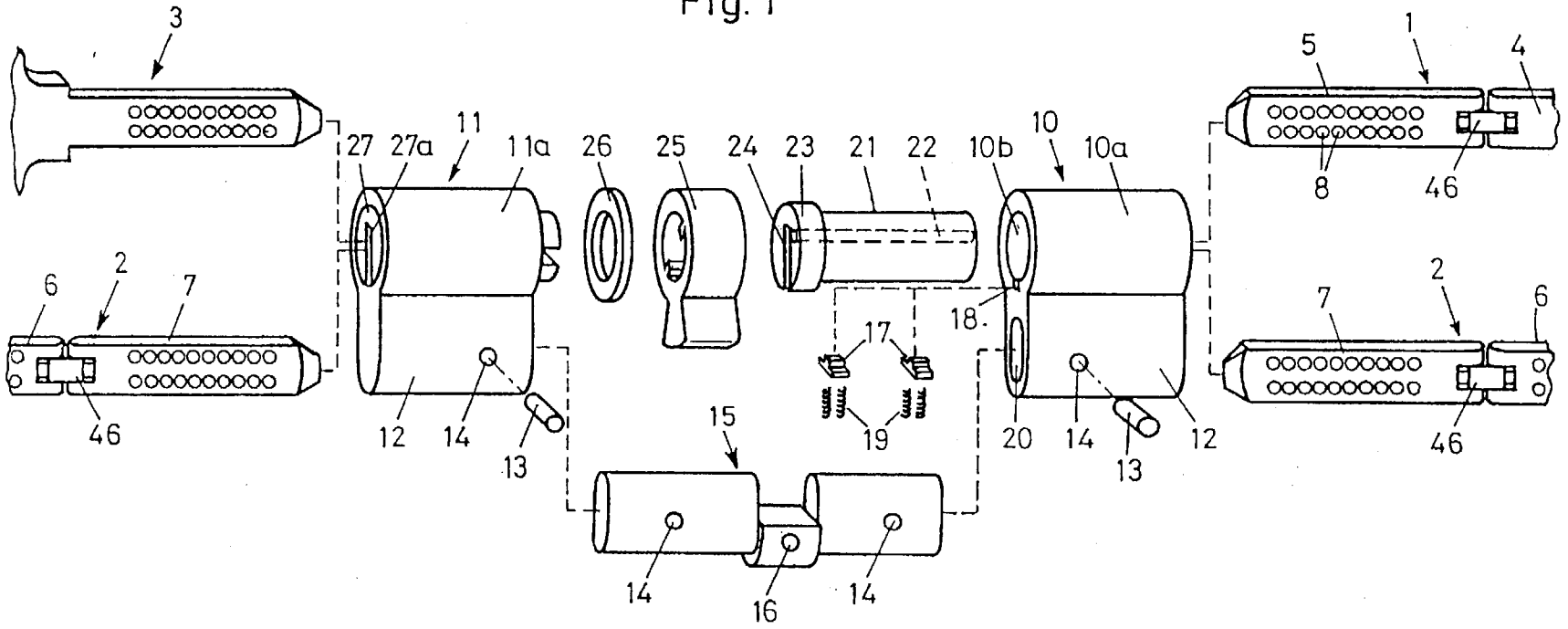
FIG. 1 is a view of a key, according to the invention, and an installation double cylinder, according to the invention, in which the individual parts are spread out for illustrative purposes.

FIG. 1 shows a cylinder half 10 with a housing 10*a* which has a cylindrical recess 10*b* for receiving a rotor 21. The rotor 21 is produced from hard material, in particular hardened steel, and is outfitted with hard-metal pins 22. A key guide 24 extends along the entire length of the rotor 21. The rotor 21 is inserted into the opening 10*b* from the rear side of cylinder half 10 and contacts the housing 10*a* at the rear by a flange 23. Slides 17 which hold the rotor 21 in the pull out position by the action of spring elements 19 when the key is pulled out are inserted in a longitudinal groove 18 of the recess 10*b*. The cylinder half 10 preferably has no tumblers and, in conformity with the rotor 21, no radial bore holes. In a break-in attempt, the rotor 21 which is produced from resistant material could only be cut out with a great deal of effort. Since the flange 23 contacts the housing 10*a* at the inside, it is also impossible to pull the rotor 21 out of the housing 10*a* from the keying side.

The cylinder half 10 is connected with a second cylinder half 11 by a crosspiece 15. The two ends of the crosspiece 15 engage, respectively, in a recess 20 of a cylinder pocket 12. The crosspiece 15 is connected with the cylinder halves 10 and 11 in a stationary manner by transverse pins 13 which are inserted into bore holes 14. A threaded bore hole 16 for a locking screw which fixes the double cylinder in the door lock is provided in a central thickened portion of the crosspiece 15.

The second cylinder half 11 likewise has a cylinder housing 11*a* in which a rotor 27 is supported. This rotor 27 is secured at the back by a ring 26. Cylinder half 11 can be constructed in a manner known per se, i.e., it can have conventional tumblers which can be brought into line by a conventional key 3 for releasing the rotor 27. After inserting the key 3 into the key guide 27*a*, the rotor 27 can accordingly be rotated along with the driver 25. On the other hand, if the key 3 is inserted into the key guide 24 of cylinder half 10, only the rotor 21 can be turned and, in so doing, does not carry along the driver 25. Accordingly, the key 3 cannot turn the driver 25 and, consequently, a locking bolt of the lock cannot be actuated. The double lock cylinder is generally inserted into a door in such a way that cylinder half 10 is arranged on the outside and cylinder half 11 is arranged on the inside. The double lock cylinder can then only be actuated with the key 3 from the inside.

However, it is possible to actuate the rotary lock cylinder from the outside with keys 1 and 2 shown in FIG. 1. Each of these keys 1 and 2 has a lengthening element 5 and 7, respectively, which is provided with bore holes 8, known per se, and is arranged at the front end of a standard element 4 and 6, respectively. When the key 1 is inserted into the lock cylinder from the outside, the lengthening element 5 lies in the key guide 27*a* of rotor 27 and brings the tumblers of cylinder half 11 in line by means of the control faces of bore holes 8. The rotors 21 and 27 and, along with them, the driver 25 can then be turned. However, the rotary lock cylinder cannot be operated by key 1 from the inside, since the standard element 4 which then lies in rotor 27 has no corresponding bore holes 8.

However, it is possible to operate the rotary lock cylinder from the outside and from the inside with key 2 which has corresponding bore holes 8 at the lengthening element 7 and standard element 2 as is shown in FIG. 1. A lock installation can accordingly have keys 1, 2 and 3 shown in FIG. 1. As was already explained, these three keys have different locking possibilities. In this way, locking authority in the security area can be organized more expediently. Of course, a lock installation generally has a plurality of double lock cylinders and many keys.

Figure 2:
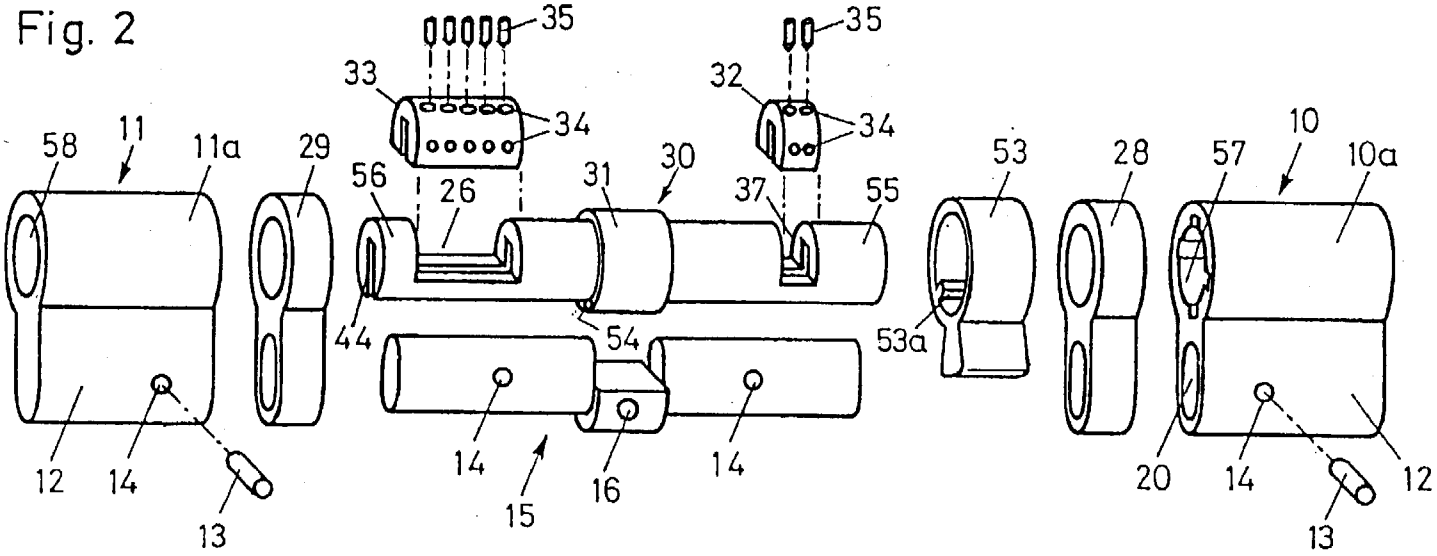
FIG. 2 shows a variant of an installation double cylinder, according to the invention, in which the individual parts are again spread out.

The double lock cylinder shown in FIG. 2 has a rotor 30 which is produced from a continuous cylindrical piece of hardened steel. The rotor 30 has a thickened portion 31 approximately in the center, a driver 53 being slid onto this thickened portion 31. The driver 53 engages in a groove 54 of the rotor 30 by a shoulder 53*a* and is accordingly connected with rotor 30 so as to be fixed with respect to rotation relative thereto. Each end 55 and 56 of the rotor has a recess 36 and 37, respectively, for an insert 33, 32 and is supported in corresponding recesses 58 and 57 of the cylinder housing 11*a* and 10*a*. A key guide 44 extends along the entire length of the rotor 30.

The inserts 33 and 32 are drilled according to a determined drilling pattern and receive core pins 35. The cylinder housings 11*a* and 10*a* have conventional housing pins, not shown, which cooperate with the core pins 35 in a known manner. Insert 32 is preferably shorter than insert 33 and, correspondingly, recess 37 is shorter than recess 36. The end 55 of the rotor 30 is accordingly substantially sturdier than the end 56 and offers great resistance to tampering, e.g., with a cutter. Apart from high security, a substantial advantage of the lock cylinder according to FIG. 2 consists in that the locking possibilities can be doubled by rotating the inserts 32 and 33. A substantial increase in the number of locking permutations is accordingly made possible in a very simple manner without additional production costs.

The housings 10*a* and 11*a* can be lengthened by means of lengthening elements 28 and 29. A key 1 and 2 associated with the latter can be adapted in a simple manner to the respective length of the double cylinder by producing the lengthening element 5 and 7 with a corresponding length. The standard element 4 and 6 need not be adapted.

Figure 3:
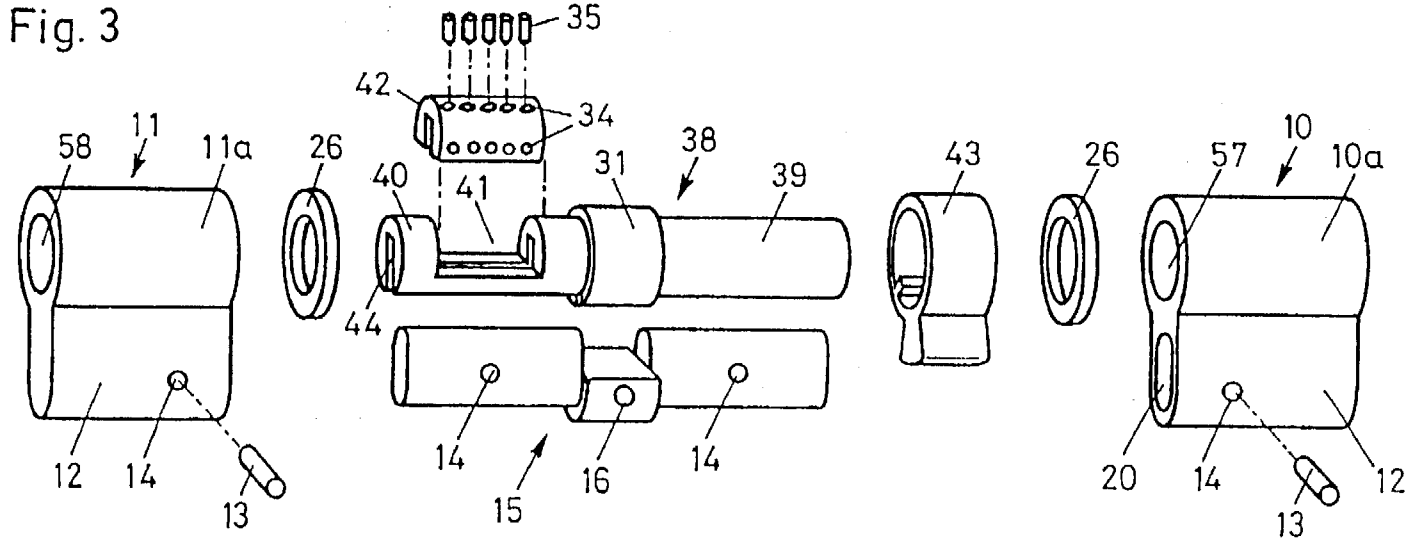
FIG. 3 shows another variant of an installation double cylinder according to the invention.

In the construction according to FIG. 3, a rotor 38 is provided which has a recess 41 at its end 40 for an insert 42 only on the inside. The rotor 38 likewise has a keyway 44 extending along its entire length. The other end 39 of the rotor 38 has no bore holes for tumblers and is solid with the exception of the keyway 44. In this case also, a driver 43 is slid onto the rotor 38 so as to be fixed with respect to rotation relative to it. As in rotor 30, this rotor also has a thickened center part 31 which effectively prevents the rotor from being pulled out of the cylinder housing. In other respects, the lock cylinder shown in FIG. 3 is constructed in the manner described above.

Figure 4:
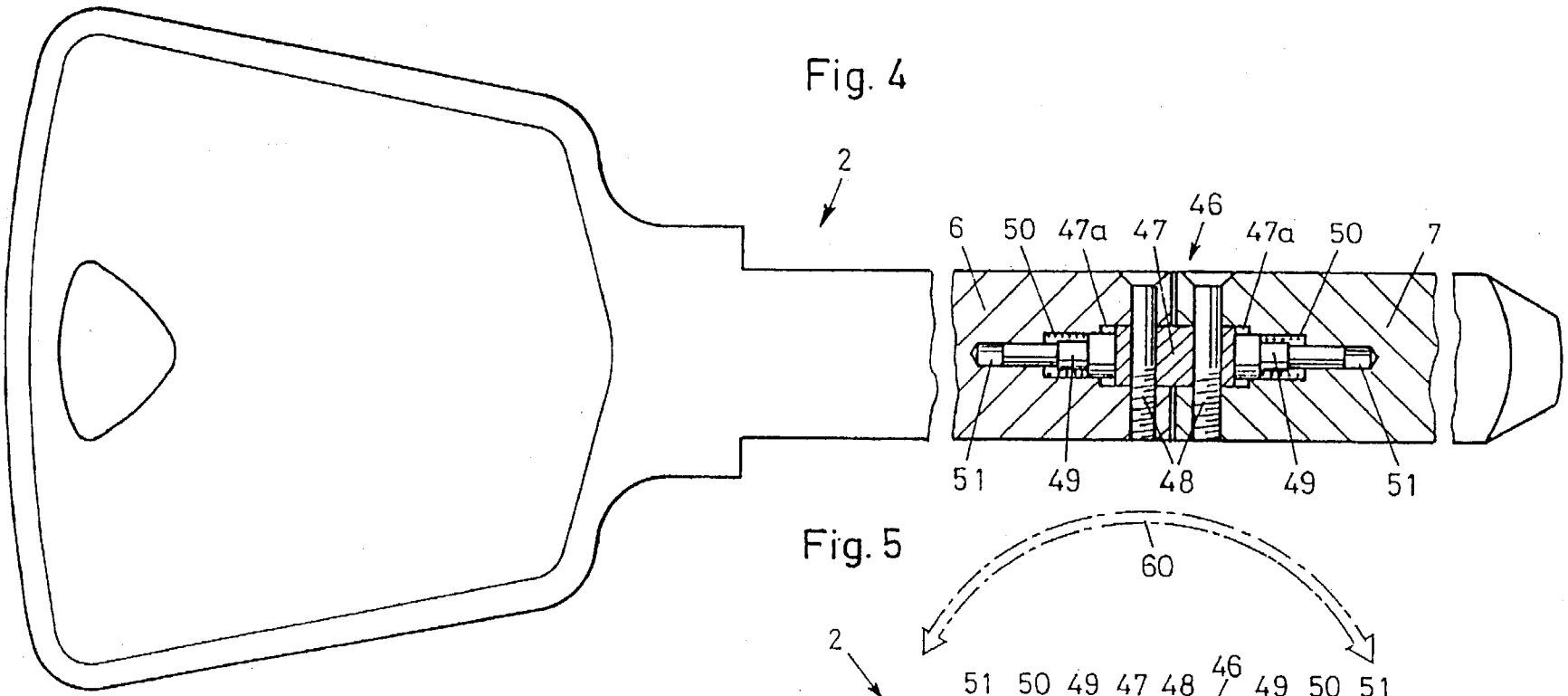
FIG. 4 shows a key according to the invention in partial section.
Figure 5:
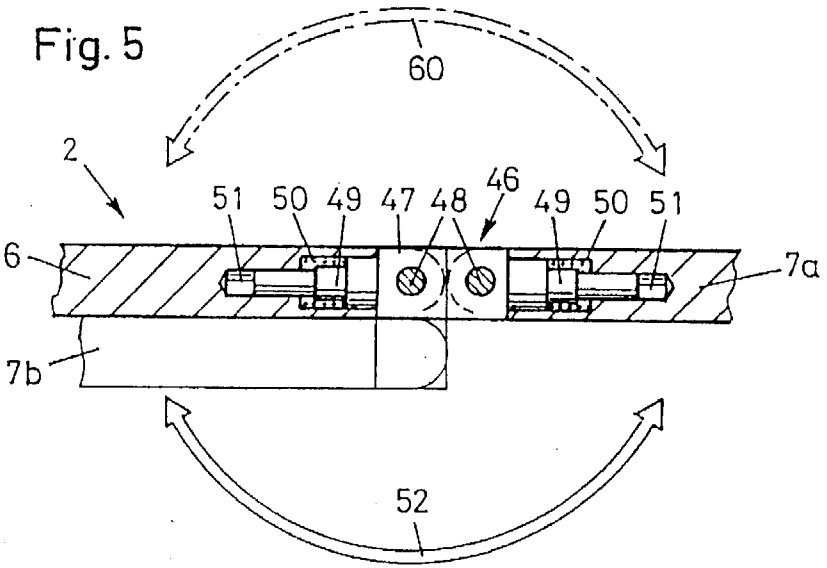
FIG. 5 shows another plan view of the key according to FIG. 4.
Figure 6:
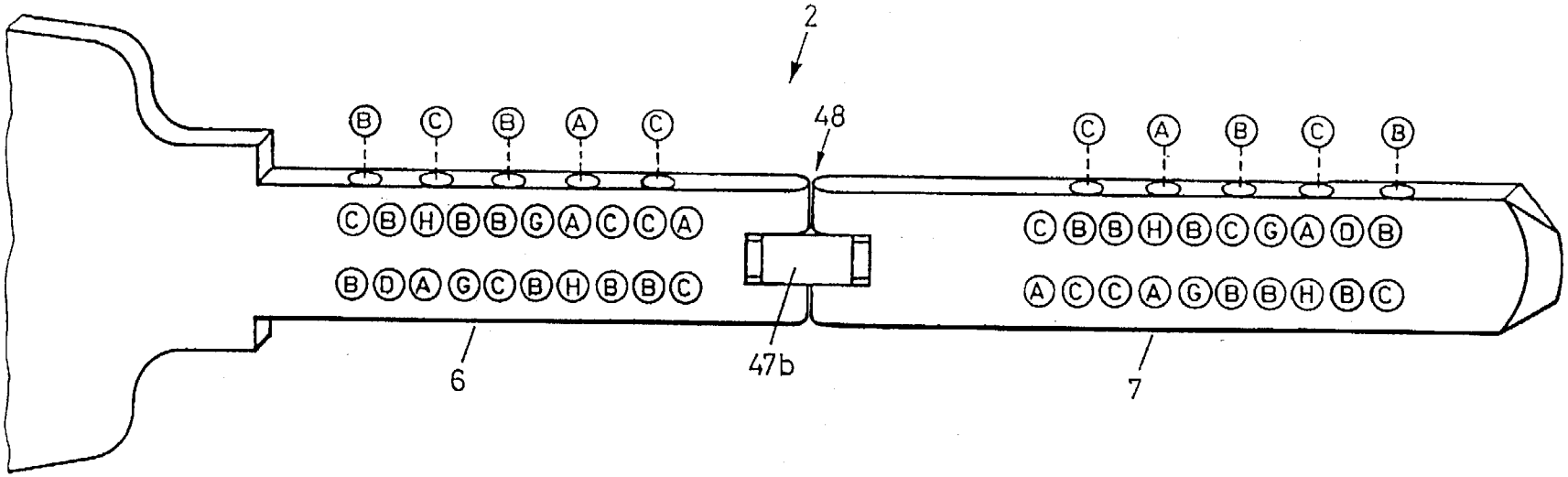
FIG. 6 shows a schematic view of the control bore holes of a key according to the invention.

FIGS. 4 to 6 show a key 2 with standard element 6 and lengthening element 7. As will be seen from FIG. 5, the key can be shortened by swiveling the lengthening element 7 around an articulation 46, i.e., it can be shortened to the conventional length for a key of this type. Reference number 7*a* shows the lengthening element in the working position and reference number 7*b* shows the lengthening element in the folded in position. Folding can be effected in the directions indicated by the double arrows 52 and 60.

The articulation has a connection plate 47 which is swivelably connected with the standard element 6 and with the lengthening element 7 by means of transverse pins 48. Pins 49 which are displaceable in a defined manner are supported in stepped bore holes 51 of standard element 45 and lengthening element 7 and contact a planar end side 47*a* of the plate 47 under the influence of a pressure spring 50 in each instance. The lengthening element 7 is fixed in position 7*a* by pins 49, but can be swiveled out of this position by a comparatively small lateral force. In position 7*b*, the pins 49 contact end sides 47*b* (FIG. 6) and also fix the lengthening element 7 in this folded in position. The key 2 can accordingly be brought to a conventional key length in a simple manner. This is also true of the key 1 shown in FIG. 1. Constructions in which the lengthening element 7 cannot be swiveled are also possible. Finally, constructions in which the bit of the key 2 can be reduced in a telescoping manner are also possible.

FIG. 6 shows a possible arrangement of bore holes on the bit of the key 2.

While the foregoing description and drawings represent the preferred embodiments of the present invention, it will be obvious to those skilled in the art that various changes and modifications may be made therein without departing from the true spirit and scope of the present invention.

What is claimed is:

1. A key and installation double cylinder for a security lock comprising:

a key having a bit;

a first cylinder half for positioning at an inner side of an access portal;

a second cylinder half for positioning at an outer side of said access portal;

a cylinder core and tumblers which are constructed as core pins and housing pins and can be brought into line by means of said key, said tumblers being located in said first cylinder half only, said second cylinder half being free of core pins and housing pins, said cylinder core including a rotor disposed in said second cylinder, said rotor being solid except for a keyway;

said key for being inserted into the keyway to release the cylinder core for rotation;

said key having, at its bit, a lengthening element by which the tumblers in an oppositely located cylinder half can be brought into line for free turning upon an insertion of said key from an outer side of the double cylinder, said key having a standard element which is disposed in said rotor upon insertion of said key from the outer side of the double cylinder, said lengthening element being connected by a swivel to said standard element.

2. The key and installation double cylinder according to claim 1, wherein the cylinder core has two rotors, at least one rotor being produced from a hard material such as hardened steel.

3. The key and installation double cylinder according to claim 2, wherein the cylinder core is outfitted with hard-metal pins.

4. The key and installation double cylinder according to claim 2, wherein the rotor disposed in said second cylinder has a flange which contacts a housing of said second cylinder on an inner side thereof.

5. The key and installation double cylinder according to claim 1, wherein the rotor is part of a continuous rotor member extending substantially along the entire length of the first cylinder half and the second cylinder half.

6. The key and installation double cylinder according to claim 5, wherein the rotor member is enlarged approximately in the center thereof.

7. The key and installation double cylinder according to claim 1, wherein the rotor member has at least one recess in which an insert is inserted and said insert is produced from a material which is substantially softer than the rest of the rotor member.

8. The key and installation double cylinder according to claim 7, wherein said material is brass.

9. The key and installation double cylinder according to claim 1, wherein at least one cylinder half has a spring-loaded slide which centers the rotor when the key is pulled out.

10. The key and installation double cylinder according to claim 1, wherein the two cylinder halves are connected with one another by a crosspiece.

11. The key and installation double cylinder according to claim 1, wherein said swivel has a plate which is fixed so as to be rotatable by pins at the lengthening element and at the standard element.

12. A lock installation having a plurality of installation double cylinders and keys according to claim 1, wherein at least one key is constructed with a lengthening element and at least one key is constructed without such lengthening element.

* * * * *